United States Patent [19]

Smith

[11] Patent Number: 4,593,514

[45] Date of Patent: Jun. 10, 1986

[54] SPACE FRAME

[75] Inventor: Todd R. Smith, Washtenaw, Mich.

[73] Assignee: GTE Products Corporation, Stamford, Conn.

[21] Appl. No.: 784,289

[22] PCT Filed: Sep. 19, 1984

[86] PCT No.: PCT/US84/01508

§ 371 Date: Nov. 5, 1984

§ 102(e) Date: Nov. 5, 1984

[87] PCT Pub. No.: WO86/01848

PCT Pub. Date: Mar. 27, 1986

[51] Int. Cl.[4] ..... F04H 12/06

[52] U.S. Cl. ..... 52/648; 52/637; 52/650; 403/171; 403/176

[58] Field of Search ..... 52/80, 81, DIG. 10, 52/637, 638, 648, 650, 651; 403/171–178; 446/85, 126

[56] References Cited

U.S. PATENT DOCUMENTS

| | | | |
|---|---|---|---|
| 2,986,241 | 5/1961 | Fuller | 446/126 X |
| 3,313,082 | 4/1967 | Seaborg et al. | 52/646 |
| 3,364,633 | 1/1968 | Polo . | |
| 3,466,824 | 9/1969 | Troutner | 52/648 |
| 3,696,574 | 10/1972 | Dietrich | 52/637 X |
| 3,731,450 | 5/1973 | DuChateau . | |
| 3,873,219 | 3/1975 | Pofferi | 403/171 |
| 4,070,847 | 1/1978 | Madl, Jr. . | |
| 4,178,736 | 12/1979 | Salas . | |
| 4,183,190 | 1/1980 | Bance . | |
| 4,214,409 | 7/1980 | Gebhardt et al. . | |
| 4,282,619 | 8/1981 | Rooney . | |
| 4,438,615 | 3/1984 | Wendel . | |
| 4,449,843 | 5/1984 | Wendel . | |
| 4,484,430 | 11/1984 | Rossman . | |

FOREIGN PATENT DOCUMENTS

| | | | |
|---|---|---|---|
| 2324184 | 11/1973 | Fed. Rep. of Germany | 52/650 |
| 2347136 | 3/1974 | Fed. Rep. of Germany | 52/648 |
| 2409635 | 9/1975 | Fed. Rep. of Germany | 52/648 |
| 879913 | 3/1943 | France | 403/171 |
| 1157537 | 5/1958 | France | 52/648 |
| 1227064 | 9/1961 | France | 52/648 |
| 1450635 | 7/1966 | France | 403/174 |
| 2299469 | 8/1976 | France | 52/648 |
| 2442309 | 7/1980 | France | 52/648 |

*Primary Examiner*—John E. Murtagh
*Assistant Examiner*—Richard E. Chilcot, Jr.
*Attorney, Agent, or Firm*—Ivan L. Ericson

[57] ABSTRACT

A space frame is made from a plurality of truss modules and transverse chords. The truss modules and transverse chords are interconnected by fasteners contained therein. The truss modules have split longitudinal chords which are abutted to interconnect the truss modules. The transverse chords interconnect with the truss modules which are alternatingly arranged in two parallel planes to form the space frame matrix.

7 Claims, 9 Drawing Figures

SPACE FRAME

FIELD OF THE INVENTION

This invention relates to space frames. More particularly, it relates to space frames of the double layer flat grid type having longitudinal and transverse chords interconnected by a plurality of web members.

BACKGROUND OF THE INVENTION

Space frames are well known and extensively used in the construction of buildings such as exhibition halls, theatres and the like where large areas are required to be covered, free of supporting columns. For such purposes, architects commonly favor space frames of the double-layer flat grid type, such a structure having an upper square grid assembly of longitudinal and transverse chord members spaced above a lower square grid assembly of longitudinal and transverse chord members, intersections of the upper and lower grids being interconnected by diagonal struts or web members so that the space frame consists of a combination of square-base pyramidal shapes.

The economy of space frames of this type is particularly sensitive to the cost of the nodal connections of the members comprising the grid. A variety of connector components have been devised for interconnecting: at each node of the structure, the longitudinal and lateral chord members, and the diagonal struts.

A typical way to make a space frame is to fabricate members and joints as unique parts and bolt them together in the field. Some systems use pyramidal modules which are field assembled.

There are three main disadvantages to those systems:

1. Costs—Where you have a node and member connection, hardware costs are high.
2. Erection Time and Difficulty—The more pieces you have, the more field assembly time required.
3. Exposed Fasteners—They are unsightly and tend to corrode.

The space frame of the present invention solves these problems by utilizing a prefabricates truss module in conjunction with transverse chords thereby reducing field assembly time by minimizing the number of parts. By concealing the few fasteners inside the truss module chord connections, corrosion of the fasteners has been minimized.

SUMMARY OF THE INVENTION

In accordance with the present invention, a new and improved space frame comprises a combination of truss modules and transverse chords which are interconnected by transverse fasteners.

The transverse chords are parallel to each other and the truss modules are alternatingly arranged in two parallel planes.

Each truss module comprises a plurality of web members, connecting members, and split longitudinal chords. The connecting members and the split longitudinal chords have first interface surfaces. The web members and the connecting members are affixed to the split longitudinal chords to form the truss modules.

The truss modules are connected to each other at the interface surfaces of the split longitudinal chords of each truss module by the transverse fastening means located within the truss modules interconnected with the transverse chords. Each truss module is also connected to the transverse chords at the interface surfaces of the connecting members of each truss module by the transverse fastening means to form the space frame.

For a better understanding of the present invention, together with other and further objects, advantages and capabilities thereof, reference is made to the following disclosure and appended claims in connection with the above-described drawing.

DETAILED DESCRIPTION OF THE INVENTION

Figure 1:
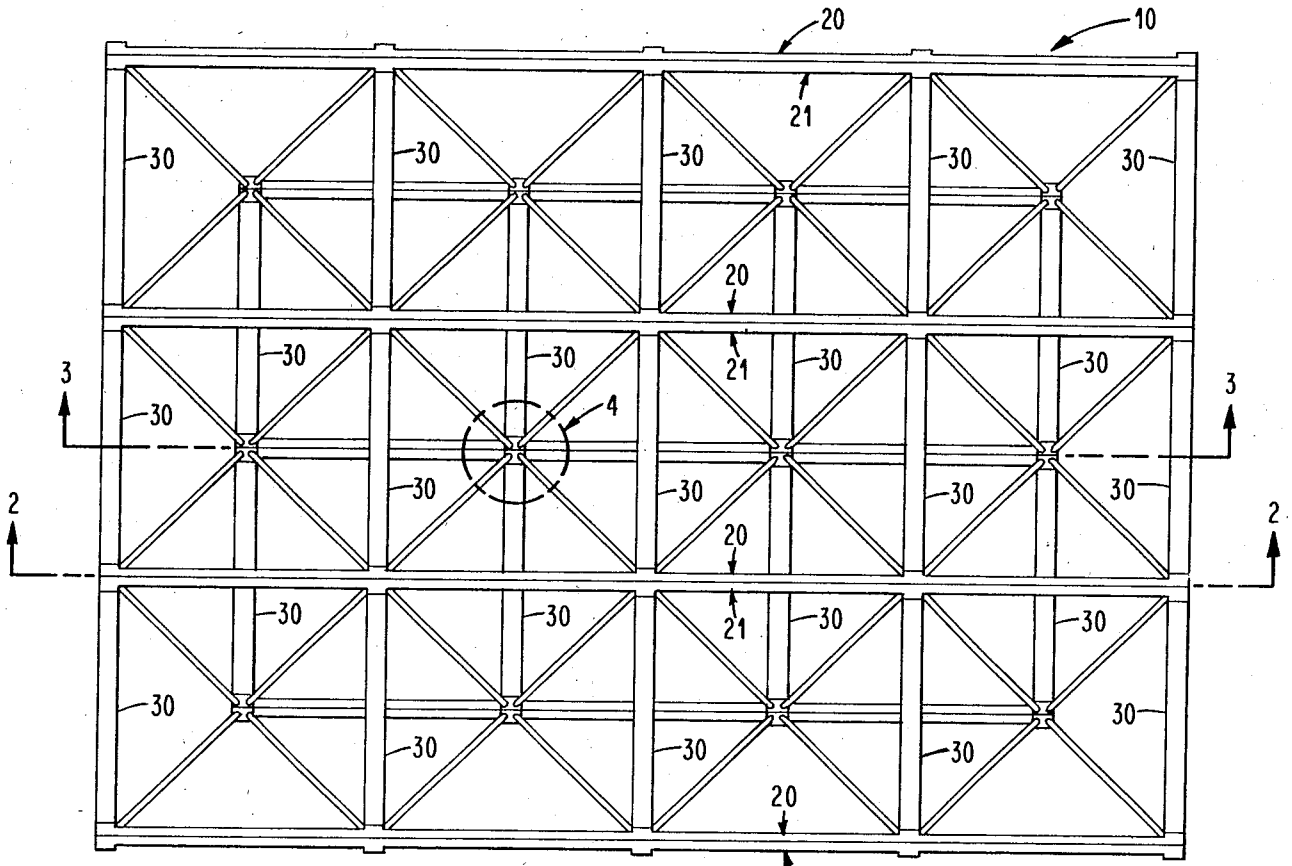
FIG. 1 is a plan view of a space frame of the present invention.
Figure 2:
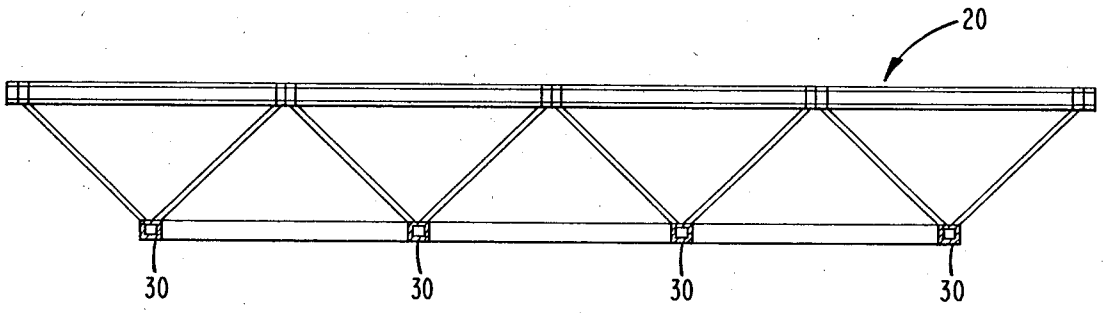
FIG. 2 is an elevational view looking along line 2—2 of FIG. 1.
Figure 3:
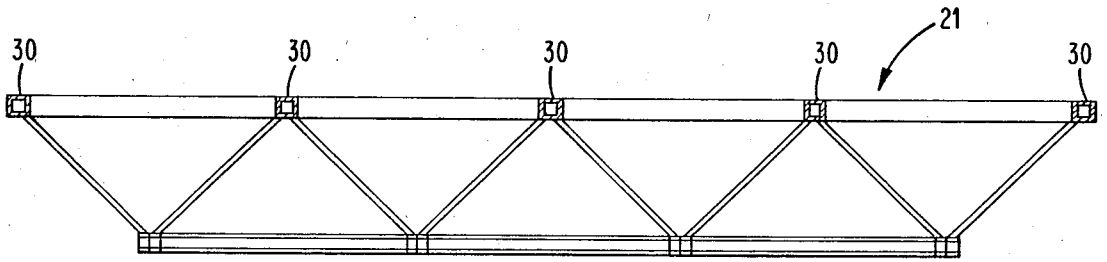
FIG. 3 is an elevational view looking along line 3—3 of FIG. 1.
Figure 4:
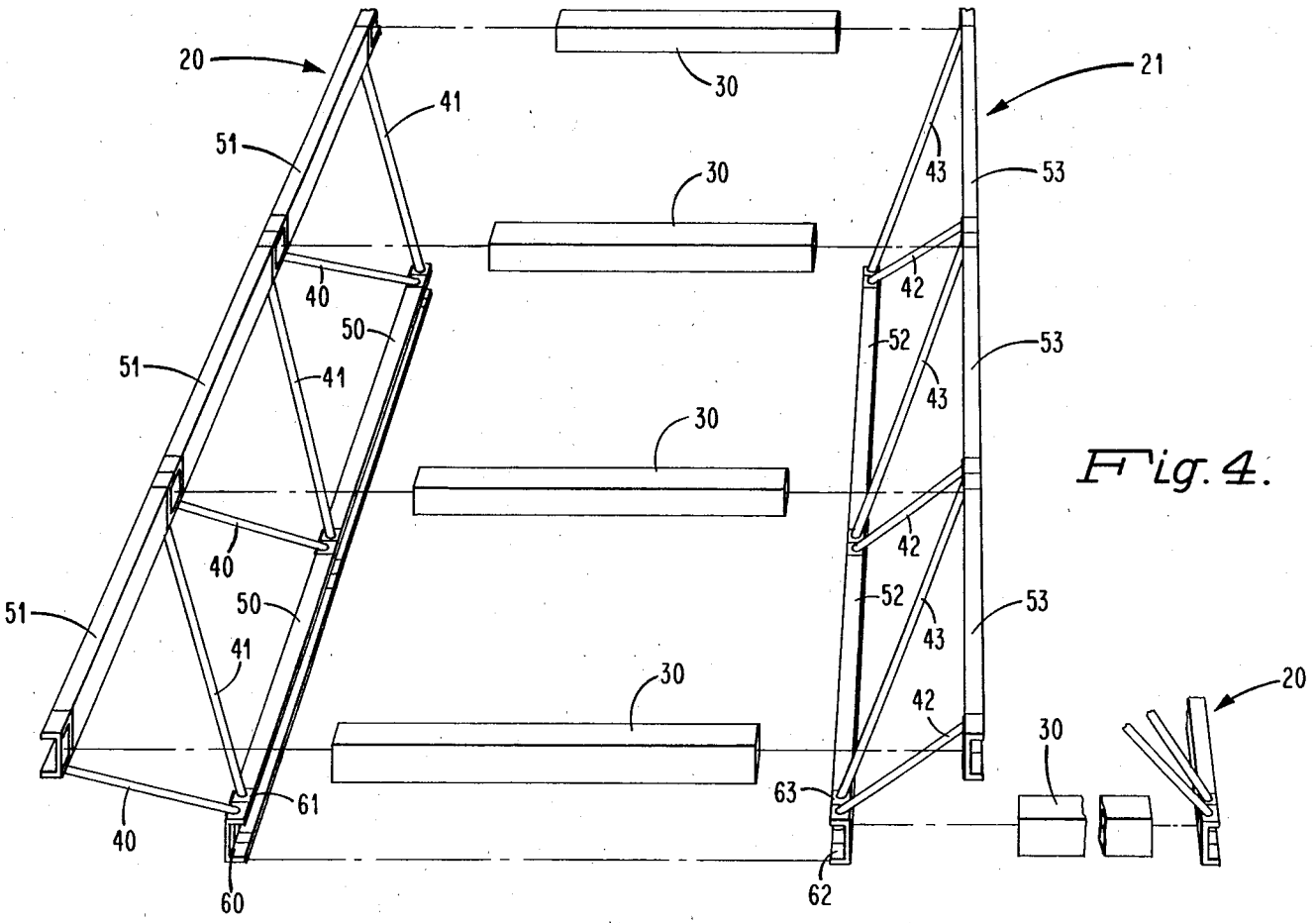
FIG. 4 is an exploded perspective segmentary view of the space frame shown in FIG. 1 showing the truss module and transverse chord arrangement.

Shown in FIG. 1 is a space frame 10 comprising a combination of truss modules 20, 21 shown in FIGS. 2, 3 and 4 and transverse chords 30.

Figure 5:
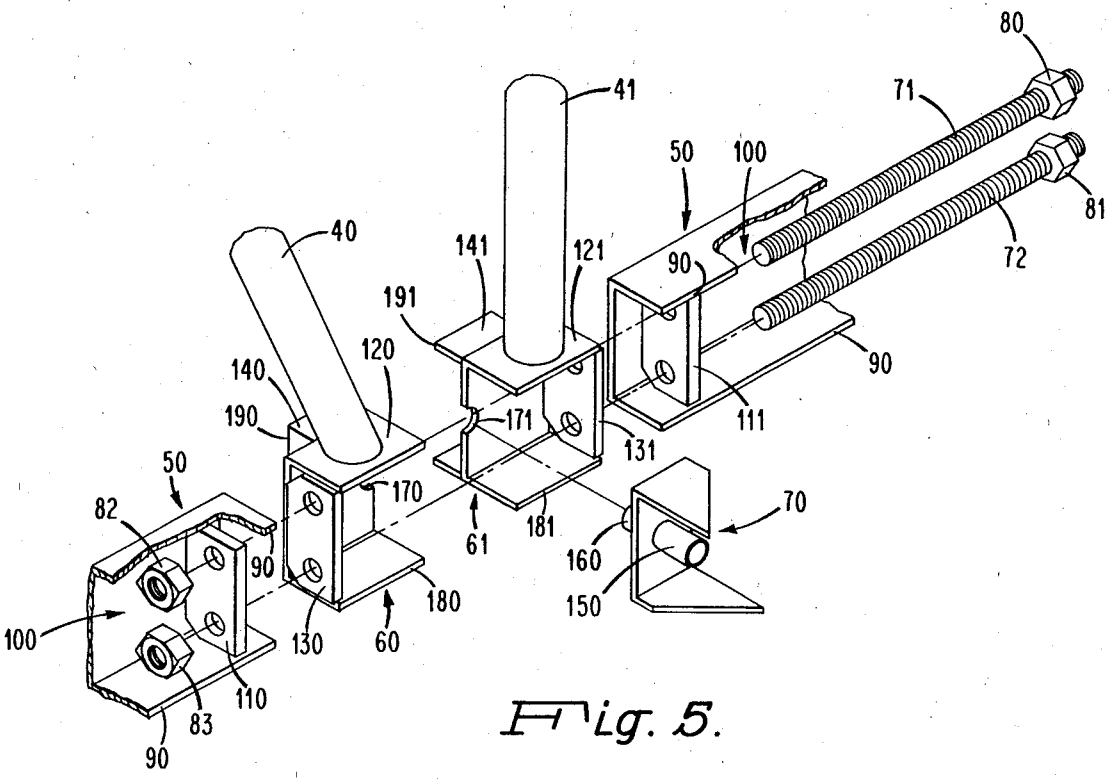
FIG. 5 is an exploded perspective segmentary view of the space frame encircled at 4 in FIG. 1 showing one manner of assembling web sections, split longitudinal chords, and a truss alinement member to form a truss module.

Shown in FIG. 4 truss module 20 has a plurality of web members 40, 41, split longitudinal chords 50, 51 and connecting members 60, 61. Also shown in FIG. 4 is truss module 21 which has a plurality of web members 42, 43, split longitudinal chords 52, 53 and connecting members 62, 63. Shown in FIG. 5 are web members 40, 41, split longitudinal chords 50, connecting members 60, 61 truss alinement member 70, longitudinal fasteners 71, 72 such as treaded rods with corresponding nuts 80, 81, 82, 83. The split longitudinal chords 50, such as "U" shaped channels, have first interface surfaces 90 and inside surfaces 100. Connecting plates 110, 111 which have two apertures each are affixed and perpendicular to the inside surfaces 100 of the split longitudinal chords 50.

The connecting members 60 and 61 have foreshorted split transverse chord portions 140, 141 and foreshortened split longitudinal chord portions 120, 121 which have affixed to them alinement members 130, 131 each having two apertures. The foreshortened split transverse chord portions 140, 141 are affixed perpendicularly to the foreshortened split longitudinal chord portions 120, 121 so that the foreshortened split longitudinal chord portions 120, 121 will aline with the split longitudinal chords 50 and the foreshortened split transverse chord portions 140, 141 will aline with the transverse chord 30 shown in FIG. 6. The truss alinement member 70 has positioning sleeves 150 and 160. Positioning sleeve 160 coacts with the two connecting members 60 and 61 which have half moon openings 170, 171 respectively to receive the positioning sleeve 160. The connecting members 60, 61 have first interface surfaces 180, 181 and second interface surfaces 190, 191.

Figure 6:
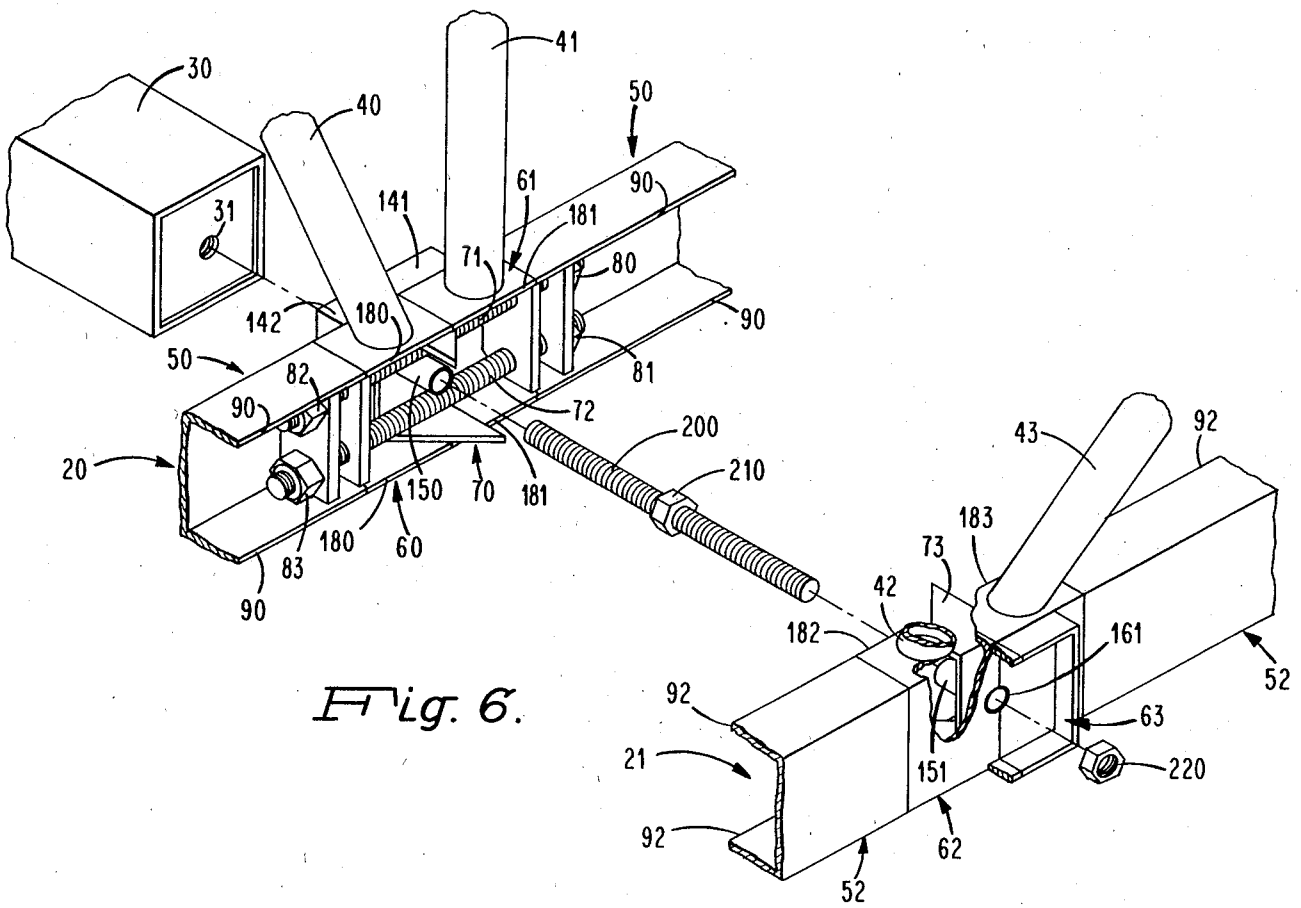
FIG. 6 is an exploded perspective segmentary view of the space frame encircled at 4 in FIG. 1, showing one manner of assembling a transverse chord and two truss modules with a fastener.

Shown in FIG. 6, the two split longitudinal chords 50; the two connecting members 60, 61 with webs members 40, 41 affixed to the connecting members 60, 61 and the truss alinement member 70 are assembled and interconnected by the longitudinal fasteners 71, 72 and their corresponding nuts 80, 81, 82, 83 to form a partial section of the truss module 20. Also shown in FIG. 6 is a partial section of another truss module 21 made up of split longitudinal chords 52 web members 42, 43, connecting members 62, 63 and a truss alinement member 73. The split longitudinal chords 52 have first interface surfaces 92 and the connecting members 62, 63 have first interface surfaces 182, 183 respectively.

The two truss modules 20, 21 are interconnected to each other and the transverse chord 30 is interconnected to the truss module 20 by coacting transverse fastener 200 with treads 31 of transverse chord 30 shown in FIG. 6. Hex nut 210 welded to transverse fastener 200 provides a means for turning transverse fastener 200 to engage treads 31 with an appropriate tool. Positioning sleeve 150 of truss alinement member 70 provides a stop for hex nut 210 since hex nut 210 can not pass between longitudinal fasteners 71, 72 because there is not enough clearance between the longitudinal fasteners 71, 72 and hex nut 210.. Once transverse chord 30 is secured to truss module 20 by transverse fastener 200, truss module 21 is positioned to abut matching interface surfaces 90, 180, 181 with interface surfaces 92, 182, 183 by sliding transverse fastener 200 through positioning sleeves 151, 161 of truss alinement member 73 and coacting truss alinement member 70 with truss alinement member 73 and securing truss module 21 by applying nut 220 to transverse fastener 200.

Figure 7:
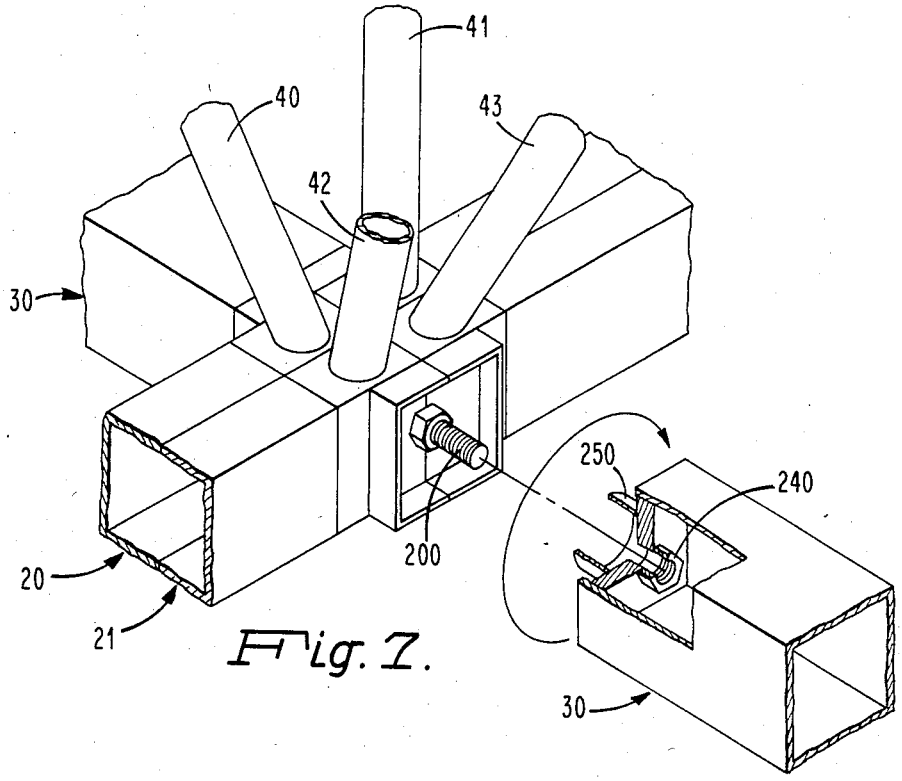
FIG. 7 is an exploded perspective segmentary view of the space encircled at 4 in FIG. 1 showing one manner of assembling a second transverse chord to the two truss modules and transverse chord shown in FIG. 6.
Figure 8:
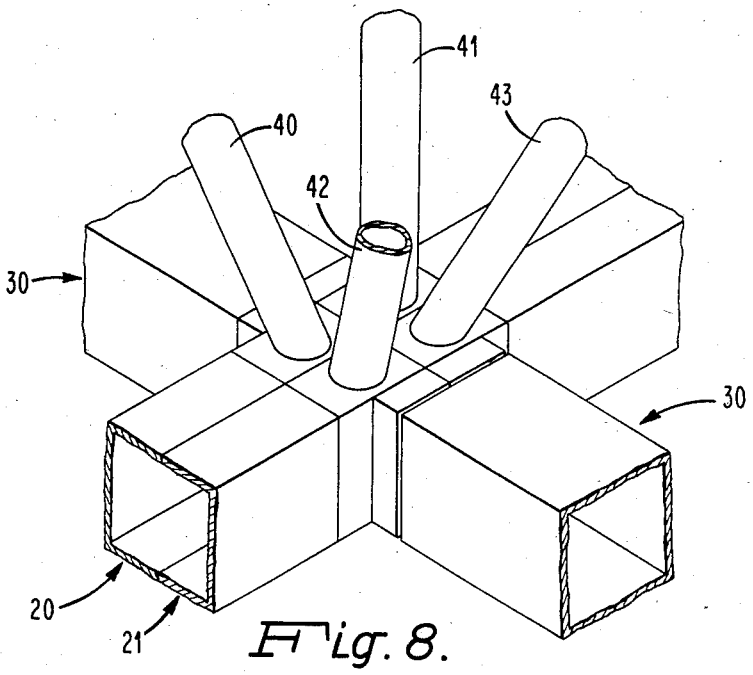
FIG. 8 is an exploded perspective segmentary view of the space frame encircled at 4 in FIG. 1 showing the completed assembly of the space frame components in FIG. 7.

Shown in FIG. 7 is the engaging of a second transverse chord 30 to the assembly of the first transverse chord 30, truss module 20 and truss module 21 by rotating the second transverse chord 30 to engage treads 240 of the second transverse chord 30 with transverse fastener 200 until the second transverse chord positioning sleeve 250 coacts with truss module 21 forming a completed assembly shown in FIG. 8.

Figure 9:
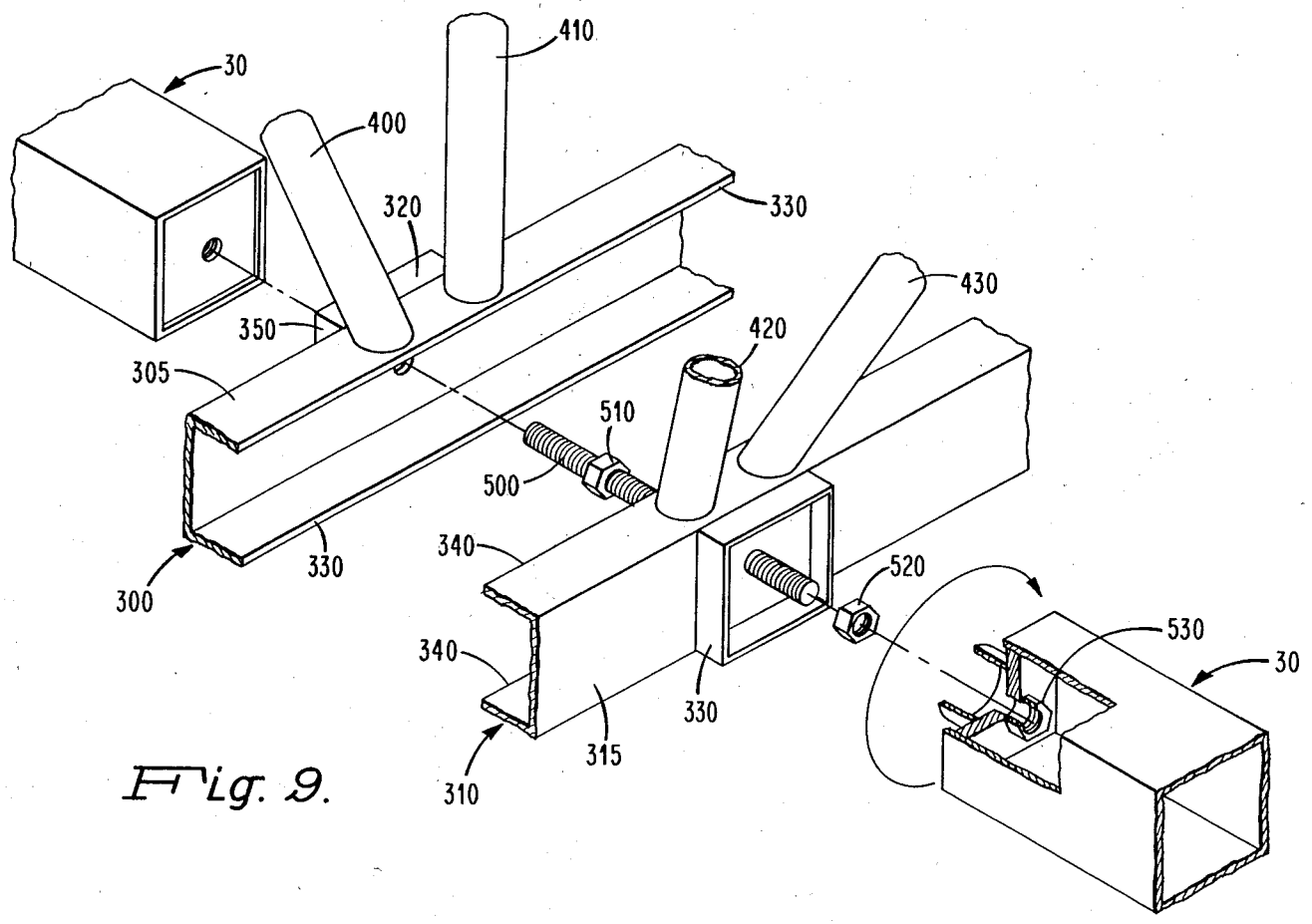
FIG. 9 is an exploded perspective segmentary view of another embodiment of the space frame encircled at 4 in FIG. 1 showing a transverse chord, two truss modules and a transverse fastener arrangement.

Shown in FIG. 9 is another embodiment of the present invention. Truss modules 300, 310 interconnect with two transverse chords 30 to form a space frame 10. Two of the transverse chords 30 interconnect with truss module 300 and truss module 310 by the engagement of transverse fastener 500 having an affixed nut 510 to transverse chord 30 and the engagement of affixed nut 510 with truss module 300 followed by the engagement of nut 520 with truss module 310 and finally the engagement of the second transverse chord 30 with the transverse fastener 500 as shown in FIG. 9.

Truss module 300 comprises split longitudinal chords 305 which have foreshortened transverse chords 320 affixed perpendicular to them, and two web members 400, 410 affixed to split longitudinal chords 305.

Truss module 310 comprises split longitudinal chords 315 which have foreshortened transverse chords 330 affixed perpendicular to them, and web members 420, 430 affixed to split longitudinal chords 315.

The transverse fastener 500 has a nut 510 affixed to it so when transverse fastener 500 engages transverse chord 30 the affixed nut 510 engages the split longitudinal chord 305 forcing the first interface 350 of foreshortened transverse chord 320 to engage transverse chord 30.

Truss module 310 engages truss module 300 at their respective first interface surfaces 330, 340 by the engagement of nut 520 against the split longitudinal chord 315 thereby forcing the two truss modules 300, 310 together and the second transverse chord 30 is attached rotating transverse chord 30 to engage threads 530 of the second transverse chord 30 with the transverse fastener 500 until the second transverse chord 30 is positioned to form a completed assembly.

The space frame of the present invention eliminates most of the connecting hardware (bolts, nodes, pins, field welds) typically required in other space frame systems.

The space frame truss modules of the present invention can be pre-assembled by welding the parts together to form a truss of desired length followed by painting to obtain a high quality paint finish or the truss parts can be painted before shop assembling into the desired truss module lengths. These truss modules can be conveniently stacked for shipment thereby reducing shipping costs.

Typically, the truss of the present invention would have separate parts painted prior to assembly comprising the split longitudinal chords, truss alinement members and web member welded to the connecting members as one piece web sections each having one web and two connecting members, as illustrated in FIG. 4, or the web members can be affixed to the connecting members by other means such as bolts after they are painted.

All the separate parts would then be assembled to make the desired truss module.

The transverse chord positioning sleeve is designed to prevent damage to the painted surfaces of the truss module while assembling the pre-painted transverse chord as shown in FIG. 7 by providing a slight gap (1/16") between the interface surface of the transverse chord and the second interface surfaces of the connecting member of the truss module. The transverse chord positioning sleeve is only required at one end of the transverse chord since the other end of the transverse chord not having the positioning sleeve as illustrated in FIG. 6 interconnects with the truss module without turning the transverse chord as is required during the final assembly shown in FIG. 7.

The longitudinal fasteners such as threaded rods, "U" bolts, turn buckets, etc. and the transverse fasteners are hidden from view once the parts are assembled as shown in FIG. 7.

The space frame end portions can be finished off by bolting end channels having recessed bolt holes to achieve a space frame having an ethically pleasing appearance for less cost while maintaining the ability to carry the same applied loads as other space frame systems.

The material of construction of the present invention can be of any suitable structural material such as steel, aluminum, magnesium, wood, etc.

The shape of the chords and web members can vary depending upon the structural and esthetic needs, i.e., such as round, square, elliptical, etc.

While there has been shown and described what is at present considered the preferred embodiment of the invention, it will be obvious to those skilled in the art that various changes and modifications may be made therein without departing from the scope of the invention as defined by the appended claims.

What is claimed is:

1. A space frame comprising a combination of truss modules and transverse chords being interconnected by transverse fastening means; said transverse chords being parallel to each other; said truss modules being alternatingly by arranged in two parallel planes; each truss module comprising a plurality of web members, connecting members, and split longitudinal chords; said connecting members having interface surfaces; said split longitudinal chords having interface surfaces; said web members and said connecting members being affixed to said split longitudinal chords to form said truss modules; said truss modules being connected to each other at said interface surfaces of said split longitudinal chords by said transverse fastening means located within said truss modules interconnected with said transverse chords; and said transverse chords being connected at said first interface surfaces of said connecting members of each truss module by said transverse fastening means to form said space frame.

2. A space frame in accordance with claim 1 wherein said transverse fastening means comprises a treaded rod coating with a treaded aperture of each transverse chord; said threaded rod having a nut affixed to the center portion of said threaded rod to effectuate a turning of said threaded rod with an appropriate tool.

3. A space frame in accordance with claim 1 wherein said split longitudinal chords being essentially "U" shaped.

4. A space frame in accordance with claim 1 wherein said web member is affixed to said connecting member by welding.

5. A space frame in accordance with claim 1 wherein said split longitudinal chords are affixed to said connecting member by a longitudinal fastening means.

6. A space frame in accordance with claim 1 wherein said connecting members are foreshortened transverse chord portions affixed perpendicularly to said split longitudinal chords and alined with said transverse chords; said foreshortened transverse chord portions coact with said transverse chords.

7. A space frame comprising a combination of truss modules and transverse chords being interconnected by transverse fastening means; said transverse chords being parallel to each other; said truss modules being alternatingly by arranged in two parallel planes; each truss module comprising a plurality of connecting members, web members being affixed to said connecting members, longitudinal fastening means, and split longitudinal chords; said connecting members having first and second interface surfaces; said split longitudinal chords having first interface surfaces, inside surfaces and connecting means; said connecting means being affixed and perpendicular to said inside surfaces of said split longitudinal chords; said connecting members having foreshortened split longitudinal chord portions and foreshorted split transverse chord portions; said foreshortened split, longitudinal chord portions having alinement members; said foreshortened split transverse chord portions being affixed perpendicularly to said foreshortened split longitudinal chord portions; said foreshortened split longitudinal chord portions alining with said split longitudinal chords and said foreshortened split transverse chord portions alining with said transverse chords; said truss alinement member having positioning sleeves; said positioning sleeves coact with said connecting members; said connecting members having apertures for receiving said positioning sleeves; said connecting members having first interface surfaces and second interface surfaces; said split longitudinal chords, said connecting members having web members affixed to said connecting members, and said truss alinement members being interconnected by said longitudinal fastening means to form said truss modules; said truss modules being connected to each other at said first interface surfaces of said split longitudinal chords and said first interface surfaces of said connecting members of each truss module by said transverse fastening means located within said connecting members and being connected to said transverse chords at said second interface surfaces of said connecting members of each truss module by said transverse fastening means to form said space frame.

* * * * *

UNITED STATES PATENT AND TRADEMARK OFFICE

CERTIFICATE OF CORRECTION

PATENT NO. : 4,593,514

DATED : June 10, 1986

INVENTOR(S) : Todd R. Smith

It is certified that error appears in the above-identified patent and that said Letters Patent are hereby corrected as shown below:

Column 1, line 42, delete "prefabricates" and insert --prefabricated--.

Column 2, line 19, delete "alinement" and insert --alignment--.

Column 3, line 14, delete "webs" and insert --web--.

Column 5, line 31, claim 2, delete "treaded" and insert --threaded--.

Column 6, lines 18-19, claim 7, delete "fore-shorted" and insert --foreshortened--.

Signed and Sealed this

Fourth Day of November, 1986

[SEAL]

*Attest:*

DONALD J. QUIGG

*Attesting Officer*

*Commissioner of Patents and Trademarks*